US009256147B2

(12) United States Patent
Yamaguchi et al.

(10) Patent No.: US 9,256,147 B2
(45) **Date of Patent: *Feb. 9, 2016**

(54) TONER, AND IMAGE FORMING METHOD AND PROCESS CARTRIDGE USING THE TONER

(71) Applicant: RICOH COMPANY, LTD., Ohta-Ku, Tokyo (JP)

(72) Inventors: Hideyuki Yamaguchi, Numazu (JP); Hachiroh Tosaka, Numazu (JP); Tomoyuki Satoh, Numazu (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/737,230

(22) Filed: Jan. 9, 2013

(65) Prior Publication Data

US 2013/0122417 A1 May 16, 2013

Related U.S. Application Data

(62) Division of application No. 11/983,690, filed on Nov. 9, 2007, now Pat. No. 8,372,569.

(30) Foreign Application Priority Data

Nov. 17, 2006 (JP) ..... 2006-311162
Sep. 12, 2007 (JP) ..... 2007-236088
Sep. 20, 2007 (JP) ..... 2007-243514

(51) Int. Cl.

| | |
|---|---|
| ***G03G 9/087*** | (2006.01) |
| ***G03G 9/08*** | (2006.01) |
| ***G03G 9/097*** | (2006.01) |
| ***G03G 13/20*** | (2006.01) |
| ***G03G 21/18*** | (2006.01) |

(52) U.S. Cl.

CPC ..... *G03G 9/0827* (2013.01); *G03G 9/0802* (2013.01); *G03G 9/08753* (2013.01); *G03G 9/09716* (2013.01); *G03G 9/09725* (2013.01); *G03G 13/20* (2013.01); *G03G 21/18* (2013.01)

(58) Field of Classification Search

CPC ..... G03G 9/0827; G03G 9/0815; G03G 9/09725; G03G 9/08753; G03G 13/08; G03G 13/20

USPC ..... 430/110.3, 108.7, 109.1, 123.51, 430/123.52, 124.4

See application file for complete search history.

(56) References Cited

U.S. PATENT DOCUMENTS

| | | | | |
|---|---|---|---|---|
| 4,401,740 | A | 8/1983 | Kawabata et al. | |
| 4,670,368 | A | 6/1987 | Tosaka et al. | |
| 4,762,763 | A | 8/1988 | Nomura et al. | |
| 5,164,774 | A | 11/1992 | Tomita et al. | |
| 5,527,657 | A | 6/1996 | Takeda et al. | |
| 5,840,456 | A | 11/1998 | Tomita et al. | |
| 5,882,832 | A | 3/1999 | Tosaka et al. | |
| 6,004,715 | A | 12/1999 | Suzuki et al. | |
| 6,022,661 | A | 2/2000 | Kurose et al. | |
| 6,063,537 | A | 5/2000 | Nakamura et al. | |
| 6,168,894 | B1 | 1/2001 | Aoki et al. | |
| 6,174,641 | B1 | 1/2001 | Nakamura et al. | |
| 6,183,928 | B1 | 2/2001 | Sata et al. | |
| 6,335,138 | B1 | 1/2002 | Kurose et al. | |
| 6,360,068 | B1 | 3/2002 | Kinoshita et al. | |
| 6,395,443 | B2 | 5/2002 | Kuroda et al. | |
| 6,416,914 | B1 | 7/2002 | Nakamura et al. | |
| 6,432,589 | B1 | 8/2002 | Uchinokura et al. | |
| 6,498,905 | B1 | 12/2002 | Tsuruya | |
| 6,503,676 | B2 | 1/2003 | Yamashita et al. | |
| 6,737,210 | B2 | 5/2004 | Uchinokura et al. | |
| 6,821,699 | B2 | 11/2004 | Kondou et al. | |
| 6,855,468 | B1 | 2/2005 | Yamamoto et al. | |
| 6,969,574 | B1 | 11/2005 | Tosaka et al. | |
| 7,090,955 | B2 | 8/2006 | Tosaka et al. | |
| 7,250,240 | B2 | 7/2007 | Tosaka et al. | |
| 8,372,569 | B2 * | 2/2013 | Yamaguchi et al. | 430/108.7 |

(Continued)

FOREIGN PATENT DOCUMENTS

| | | | |
|---|---|---|---|
| EP | 1 249 735 | A2 | 10/2002 |
| EP | 1 439 429 | A | 7/2004 |
| EP | 1 515 193 | A | 3/2005 |

(Continued)

OTHER PUBLICATIONS

European Patent Office, extended European search report dated Feb. 6, 2008 in European Patent Application No. 07120312.9-1217, Ricoh Company, Ltd.

Japanese Patent Office, Information Offer Form (Jun. 30, 2010), Japanese Patent Application No. 2007-243514 (Ricoh).

Japanese Patent Office, Office Action dated Aug. 29, 2011 in Japanese Patent Application No. 2007-243514 (Ricoh).

Japanese Patent Office, Office Action dated Jan. 10, 2012 in Japanese Patent Application No. 2007-243514 (Ricoh).

*Primary Examiner* — Janis L Dote

(74) *Attorney, Agent, or Firm* — Cooper & Dunham LLP

(57) ABSTRACT

A toner is provided including toner particles A having a circularity of greater than 0.93 and not greater than 1.00 and toner particles B having a circularity of from 0.85 to 0.93, wherein the following relationships are satisfied: $70 \leq R_A \leq 95$, $5 \leq R_B \leq 30$, $0.014 \leq SD \leq 0.025$, and $0.940 \leq ED \leq 0.950$, wherein $R_A$ (% by number) represents a ratio of a number of the toner particles A to a total number of toner particles included in the toner, $R_B$ (% by number) represents a ratio of a number of the toner particles B to the total number of toner particles included in the toner, SD represents a standard deviation of circularity of the toner particles A, and ED represents an average envelope degree of the toner particles B.

18 Claims, 4 Drawing Sheets

(56) References Cited

U.S. PATENT DOCUMENTS

| | | | |
|---|---|---|---|
| 2003/0036008 | A1 | 2/2003 | Yamazaki et al. |
| 2004/0067189 | A1 | 4/2004 | Sugiura et al. |
| 2004/0234882 | A1 | 11/2004 | Matsui et al. |
| 2005/0079429 | A1 | 4/2005 | Hayami et al. |
| 2005/0095516 | A1 | 5/2005 | Ohmura et al. |
| 2005/0208398 | A1 | 9/2005 | Ohmura et al. |

FOREIGN PATENT DOCUMENTS

| | | | |
|---|---|---|---|
| JP | 6-067461 | A | 3/1994 |
| JP | 06-148926 | | 5/1994 |
| JP | 08-062893 | A | 3/1996 |
| JP | 09-043909 | A | 2/1997 |
| JP | 09-134027 | A | 5/1997 |
| JP | 10-319622 | A | 12/1998 |
| JP | 2996629 | | 10/1999 |
| JP | 3009994 | | 12/1999 |
| JP | 2000-003063 | A | 1/2000 |
| JP | 2000-003068 | A | 1/2000 |
| JP | 2001-100456 | A | 4/2001 |
| JP | 2001-100459 | A | 4/2001 |
| JP | 2001-134015 | A | 5/2001 |
| JP | 2001-222132 | A | 8/2001 |
| JP | 2002-023409 | A | 1/2002 |
| JP | 2002-107992 | A | 4/2002 |
| JP | 2002-372802 | A | 12/2002 |
| JP | 2004-004507 | A | 1/2004 |
| JP | 2004-102236 | A | 4/2004 |
| JP | 2004-212789 | A | 7/2004 |
| JP | 2005-010723 | A | 1/2005 |
| JP | 2005-107517 | A | 4/2005 |
| JP | 2005-157314 | A | 6/2005 |
| JP | 2005-215253 | A | 8/2005 |
| JP | 2005-215255 | A | 8/2005 |
| JP | 2006-208758 | A | 8/2006 |
| JP | 2006-259311 | A | 9/2006 |
| JP | 2006-293335 | A | 10/2006 |
| JP | 2007-079223 | A | 3/2007 |
| JP | 2007-193048 | A | 8/2007 |

* cited by examiner

TONER, AND IMAGE FORMING METHOD AND PROCESS CARTRIDGE USING THE TONER

CROSS REFERENCE TO RELATED APPLICATION

This application is a division of copending U.S. patent application Ser. No. 11/983,690 filed Nov. 9, 2007.

BACKGROUND OF THE INVENTION

1. Field of the Invention

The present invention relates to a toner for use in electrophotography. Particularly, the present invention also relates to an image forming method and a process cartridge using the toner.

2. Discussion of the Related Art

An electric or a magnetic latent image is generally developed with a toner to become visible. The toner typically comprises colored particles in which a colorant, a charge controlling agent, and other additives are contained in a resin. Toner manufacturing methods are broadly classified into pulverization methods and polymerization methods. The pulverization method includes steps of melt-mixing toner components, such as a colorant, a charge controlling agent, and an offset inhibitor, with a thermoplastic resin so that the toner components are uniformly dispersed in the resin; pulverizing the melt-mixed mixture; and classifying the pulverized mixture.

The pulverization method is capable of providing a toner having desired toner properties to some extent. Cross sections made by the pulverization typically include cracks. When a stress is externally applied to the cracks, ultrafine particles tend to peel off therefrom. In a two-component development process, ultrafine particles tend to be produced from the cross sections (i.e., the surface of the toner particle) and adhere to the surface of a magnetic carrier, due to the application of agitation stress thereto. Thereby, the charging ability of the carrier deteriorates and the toner cannot be charged to the desired level.

In attempting to solve the above problems of the pulverization method, unexamined published Japanese Patent Application No. (hereinafter referred to as JP-A) 09-43909 discloses a suspension polymerization method as a toner manufacturing method. The suspension polymerization method is capable of providing a toner not only including few cracks, but also having a spherical shape and a narrow particle diameter distribution. The use of the spherical toner is capable of improving latent image reproducibility, resulting in producing high quality images. However, such a spherical toner is hardly charged, because the spherical toner tends to slip when triboelectrically-charged by a carrier in a two-component development process. In particular, in a development process in which fresh toner particles are successively supplied, such as a continuous printing of a high-image-proportion image, the fresh toner particles cannot be rapidly charged. Therefore, background fouling in that the background portion of an image is soiled with toner particles tends to be caused.

There is another disadvantage that spherical toner particles are difficult to remove with a cleaning blade when remaining on a photoreceptor. When an image having a low image area proportion is developed or transferred, few toner particles tend to remain on the photoreceptor, which are easily removed. In contrast, when an image having a high image area proportion (such as a photograph) is developed or transferred or paper is not efficiently supplied, toner particles which are not transferred and remain on the photoreceptor tend to cause the background fouling. Such remaining toner particles also tend to contaminate a charging roller, configured to contact-charge the photoreceptor, and deteriorate the charging ability thereof.

In attempting to solve the above problems, JP-As 08-62893 and 2007-79223 have disclosed toners in which a polymerization toner and a pulverization toner are mixed. The pulverization toner is mixed as an auxiliary component so that the resultant toner is easily removed with a blade. However, the pulverization toner, which includes cracks, cannot be prevented from producing ultrafine particles and tends to adhere to the carrier. As a result, charging ability of the carrier deteriorates. On the other hand, the polymerization toner, which is a main component of the resultant toner, tends to slip on the surface of the carrier when supplied to a development device. Therefore, the polymerization toner cannot be sufficiently frictionized and cannot be rapidly charged, resulting in causing background fouling. These problems cannot be solved even if the mixing ratio of the polymerization and pulverization toners is varied.

SUMMARY OF THE INVENTION

Accordingly, an object of the present invention is to provide a toner capable of producing high quality images for a long period of time.

Another object of the present invention is to provide an image forming method and a process cartridge capable of producing high resolution images.

These and other objects of the present invention, either individually or in combinations thereof, as hereinafter will become more readily apparent can be attained by a toner, comprising:

toner particles A having a circularity of greater than 0.93 and not greater than 1.00; and toner particles B having a circularity of from 0.85 to 0.93, wherein the following relationships are satisfied:

$$70 \le R_A \le 95$$

$$5 \le R_B \le 30$$

$$0.014 \le SD \le 0.025$$

$$0.940 \le ED \le 0.950$$

wherein $R_A$ (% by number) represents a ratio of a number of the toner particles A to a total number of toner particles included in the toner, $R_B$ (% by number) represents a ratio of a number of the toner particles B to the total number of toner particles included in the toner, SD represents a standard deviation of circularity of the toner particles A, and ED represents an average envelope degree of the toner particles B; and an image forming method and a process cartridge using the toner.

BRIEF DESCRIPTION OF THE DRAWINGS

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
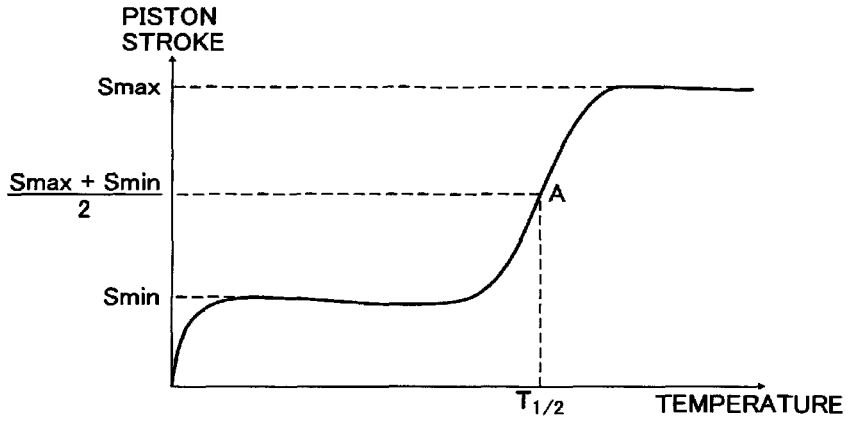
FIG. 1 is an example flow curve obtained by a flowtester to explain how to determine the ½ method melting temperature.

To achieve such objects, the present invention contemplates the provision of a toner including toner particles A having a circularity of greater than 0.93 and not greater than 1.00 and toner particles B having a circularity of from 0.85 to 0.93, wherein the following relationships are satisfied:

$$70 \leq R_A \leq 95$$

$$5 \leq R_B \leq 30$$

$$0.014 \leq SD \leq 0.025$$

$$0.940 \leq ED \leq 0.950$$

wherein $R_A$ (% by number) represents the ratio of the number of the toner particles A to the total number of toner particles included in the toner, $R_B$ (% by number) represents the ratio of the number of the toner particles B to the total number of toner particles included in to the toner, SD represents the standard deviation of circularity of the toner particles A, and ED represents the average envelope degree (based on area) of the toner particles B.

When $R_A$ is too small, reproducibility of a latent image significantly deteriorates. When $R_A$ is too large, supplied fresh toner particles are insufficiently triboelectrically-charged immediately after being supplied to a development device. When a toner includes toner particles A having a circularity of greater than 0.93 and not greater than 1.00 as main components, and toner particles B having a circularity of from 0.85 to 0.93 as auxiliary components in an amount of from 5 to 30% by number, the problem of insufficient triboelectric-charging of supplied fresh toner particles can be solved. This is because the toner particle A, having a substantially spherical shape, can be prevented from slipping on the surface of a carrier when the toner particle B, having an irregular shape, is present together. As a result, the toner can be sufficiently triboelectrically-charged even immediately after fresh toner particles are supplied to a development device. The toner particle A having a substantially spherical shape easily slips on the surface of a carrier, whereas the toner particle B having an irregular shape hardly slips thereon. Therefore, the toner particle B may have a function of preventing the toner particle A from slipping on the surface of a carrier. When $R_B$ is too small, the problem of insufficient triboelectric-charging of supplied fresh toner particles cannot be solved. When $R_B$ is too large, reproducibility of a latent image significantly deteriorates.

In the present invention, the toner particles B have an average envelope degree (based on area) of from 0.940 to 0.950. In other words, the toner particles B have a relatively large envelope degree (based on area) while having a relatively small circularity. Because of having a small circularity, the toner particles B hardly slip on the surface of a carrier and easily adhere thereto. In order to prevent a toner particle from adhering and fixing to the surface of a carrier, the toner particle may have a relatively large envelope degree (based on area), i.e., the toner particle may have a few concavities and convexities on the surface thereof. This is because such toner particle may not be so damaged that ultrafine particles are produced, which tend to fix to the surface of a carrier, even when an impact is externally applied thereto. For the above reasons, the toner of the present invention is capable of being charged to a desired level for a long period of time. When the average envelope degree (based on area) of the toner particles B is too large, the function of the toner particles B of accelerating the triboelectric-charging between a carrier and the toner particles A deteriorates.

In the present invention, the toner particles A have a standard deviation of circularity of from 0.014 to 0.025. In other words, each of the toner particles A has a various shape (e.g., a spherical shape, a bell-like cone shape, a flat shape). Toner particles having a large average circularity and a small standard deviation of circularity tend to cause a problem in that an edge portion of an image is smudged when the image is transferred. This is because such toner particles easily form a close-packed structure and aggregate when a transfer pressure is applied thereto, so that the transfer defects are microscopically occurred. If the toner particles include substantially spherical particles with various shapes, the applied transfer pressure is dispersed among the toner particles, resulting in preventing the occurrence of transfer defect. When the standard deviation of circularity is too large, reproducibility of a latent image (in particular, a thin line image) significantly deteriorates.

Since the toner of the present invention includes toner particles having various shapes, such as a spherical shape, a bell-like cone shape, and a flat shape, the contact area between each of the toner particles is increased. Therefore, high-temperature preservability of the toner tends to deteriorate especially when the toner particles include a resin capable of sharply melting, for the sake of using in a non-contact fixing system. However, this problem can be solved by mixing silica particles having a number average primary particle diameter of from 50 to 200 nm (these silica particles may be hereinafter referred to as large-sized silica particles) with the toner particles, because such large-sized silica particles function as a spacer between toner particles.

In the present invention, the large-sized silica particles preferably have a number average primary particle diameter of from 80 to 200 nm, and more preferably from 100 to 180 nm. When the number average primary particle diameter is too small, the large-sized silica particles may not satisfactorily function as a spacer between the toner particles, resulting in deterioration of high-temperature preservability of the toner. When the number average primary particle diameter is too large, the large-sized silica particles tend to release from the surfaces of the toner particles and cause a filming problem in that silica particles form a film thereof on a carrier, image forming members etc., while functioning as a spacer between the toner particles.

In the present invention, 0.05 to 1.0 parts by weight, and more preferably from 0.1 to 0.5 parts by weight, of the large-sized silica particles are mixed with 100 parts by weight of the toner particles. When the amount of the large-sized silica particles is too small, the large-sized silica particles may not satisfactorily function as a spacer between the toner particles. When the amount of the large-sized silica particles is too large, the large-sized silica particles tend to release from the surfaces of the toner particles and cause the filming problem and deterioration of the developer. Moreover, such large-sized silica particles tend to prevent toner particles from melting and bonding with each other, resulting in deterioration of glossiness of the resultant image and fixability of the toner.

As mentioned above, silica particles having a number average primary particle diameter (R) of from 80 to 200 nm may satisfactorily function as a spacer capable of preventing toner particles from aggregating with each other. In addition, such silica particles may prevent other external additives from burying in the surfaces of toner particles when the toner is preserved in a high-temperature atmosphere or is strongly agitated.

Further, the following relationship is preferably satisfied:

$$R/4 \leq \sigma \leq R$$

wherein R represents the number average primary particle diameter of silica particles and σ represents the standard deviation of particle diameter distribution of the silica particles.

When the above relationship is satisfied, the silica particles include particles having large, medium, and small particle diameters at an appropriate ratio. The silica particles having a small particle diameter may impart fluidity to the toner, whereas the silica particles having a medium or large particle diameter function as a spacer. Silica particles satisfying the above relationship have much more effective functions as an external additive compared to a mixture of particles having large, medium, and small particle diameters. Silica particles further having a shape factor SF-1 of not greater than 130 and a shape factor SF-2 of not greater than 125, i.e., silica particles having a substantially spherical shape, can improve fluidity of the toner and compatibility between the toner particles and the silica particles so that the silica particles hardly release from the toner particles.

The particle diameters of silica particles (particles of inorganic materials) can be measured using particle diameter distribution measurement instruments such as DLS-700 (manufactured by Otsuka Electronics Co., Ltd.) and COULTER N4 (manufactured by Beckman Coulter, Inc.). Since it is difficult to dissociate secondary aggregates of hydrophobized silica particles, particle diameters of such particles are preferably measured from photographs obtained using a scanning electron microscope (SEM) or a transmission electron microscope (TEM).

When using a SEM, a sample may be evaporated with a metal such as platinum. In order not to transform the sample shape by the evaporation, the evaporated metal layer preferably has a small thickness of about 1 nm or less. Alternatively, a sample may not be evaporated when observed using a high-resolution SEM (e.g., S-5200 manufactured by Hitachi, Ltd.) at a low acceleration voltage of several eV to 10 key.

When using a SEM or TEM, at least 100 particles of a sample are observed and photographed. The photograph is analyzed using an image processing device (e.g., LUZEX manufactured by Nireco Corporation) or an image processing software program to statistically determine the particle diameter distribution and the shape factors SF-1 and SF-2. It is preferable to use LUZEX AP (manufactured by Nireco Corporation) to determine the SF-1 and SF-2 in the present invention. However, the kinds of the image processing device and/or software program, and the SEM and/or TEM are not limited to any particular device.

The shape factors SF-1 and SF-2 are defined by the following equations:

$$SF\text{-}1=(L^2/A)\times(\pi/4)\times 100$$

$$SF\text{-}2=(P^2/A)\times(1/4\pi)\times 100$$

wherein L represents the diameter of the circle circumscribing an image of a particle, A represents the area of the image of the particle, and P represents the peripheral length of the image of the particle.

A heat roll fixing method, which is one example of contact heating fixing methods, has been widely used in copiers and printers using electrophotography. However, the heat roll fixing method is unsuitable for producing high definition images formed by dots, because a toner forming the dots is squashed when heat and pressure are applied thereto. Therefore, non-contact heating fixing methods have been mainly used in the field of high-quality and high-speed duplex printing or copying. The non-contact heating fixing methods have a disadvantage that a toner is not strongly fixed because a fixing pressure is not applied thereto. This weak fixation notably occurs when the fixing temperature is decreased so as to produce a matte image having a low glossiness.

The toner of the present invention can be strongly and uniformly fixed even when only a small amount of energy is applied thereto, especially in a method such as the non-contact heating fixing method. This is because the toner of the present invention includes particles having various shapes. In this case, the contact area between each of the toner particles is increased.

Both the toner particles A and B preferably include a polyol resin as a binder resin. When both the toner particles A and B include the same component, the difference in chargeability can be reduced even if they have different shapes. A typical polyol resin has thermal properties suitable for use in non-contact heating fixing methods. In addition, a typical polyol resin has high stiffness compared to other resins. Therefore, a toner using a polyol resin tends not to produce ultrafine particles even if the toner is continuously agitated, and an external additive is hardly buried in the surface of the toner. Such a toner has stable chargeability.

From the viewpoint of imparting environmental stability in charging, fixing stability, color reproducibility, glossiness stability, and resistance to paper curling after fixation to the resultant toner, a polyol resin obtained by capping both ends of an epoxy resin and having a polyoxyalkylene unit in the main chain is preferably used. For example, such a resin is obtainable by reacting an epoxy resin having glycidyl groups on both ends and an alkylene oxide adduct of divalent phenol having glycidyl groups on both ends with a dihalide, an isocyanate, a diamine, a diol, a polyphenol, or a dicarboxylic acid. Among these, a divalent phenol is preferably used in terms of reaction stability. A polyphenol and a polycarboxylic acid are also preferably used in combination with the divalent phenol as long as the reactants do not gelate. Specific examples of the alkylene oxide adduct of divalent phenol having glycidyl groups on both ends include, but are not limited to, reaction products of reactions between ethylene oxide, propylene oxide, butylene oxide, and/or a mixture thereof, and a bisphenol (e.g., bisphenol A, bisphenol F). These reaction products may be further reacted with epichlorohydrin and/or β-methyl epichlorohydrin to have a glycidyl group. In particular, a glycidyl ether of an alkylene oxide adduct of bisphenol A, represented by the following formula, is preferably used:

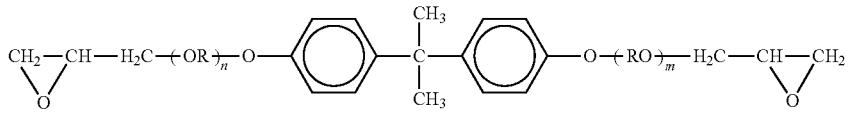

wherein R represents —$CH_2$—$CH_2$—,

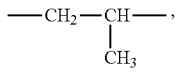

or —$CH_2$—$CH_2$—$CH_2$—; and each of n and m independently represents an integer not less than 1, and the sum of n and m is from 2 to 6.

The polyol resin for use in the present invention preferably has a number average molecular weight (Mn) of from 1,000 to 5,000, and more preferably from 1,500 to 3,500, to produce an image having good fixability and glossiness by a non-contact heating method. When the Mn is too small, glossiness of the resultant image may excessively increase and preservability of the resultant toner may deteriorate. When the Mn is too large, glossiness of the resultant image may be too small and the fixability thereof may decrease.

The ratio (Mw/Mn) of the weight average molecular weight (Mw) to the number average molecular weight (Mn) of the polyol resin for use in the present invention is preferably 2.0 to 7.0, and more preferably from 3.0 to 6.0, so as to be used for a non-contact heating fixing method. When the ratio (Mw/Mn) is too large, the toner cannot be well melted when fixed by the non-contact heating fixing method.

The polyol resin for use in the present invention preferably has a glass transition temperature of from 50 to 70° C., and more preferably from 55 to 65° C. When the glass transition temperature is too small, preservability of the resultant toner may deteriorate. When the glass transition temperature is too large, the resultant image may not have a desired glossiness and fixability.

(Charge Controlling Agent)

The toner of the present invention may include a charge controlling agent.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and salicylic acid derivatives, and organic boron compounds, but are not limited thereto.

Specific examples of commercially available charge controlling agents include, but are not limited to, BONTRON® N-03 (Nigrosine dyes), BONTRON® P-51 (quaternary ammonium salt), BONTRON® 5-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036, and COPY CHARGE® NX VP434 (quaternary ammonium salt), which are manufactured by Hoechst AG; LRA-901 and LR-147 (boron complex), which are manufactured by Japan Carl it Co., Ltd.; and compounds such as copper phthalocyanine, perylene, quinacridone, azo pigments, and polymers having a functional group such as a sulfonate group, a carboxyl group, and a quaternary ammonium group.

The toner of the present invention preferably includes the charge controlling agent in an amount of from 0.5 to 5.0 parts by weight, more preferably from 0.7 to 3.0 parts by weight, and much more preferably from 0.9 to 2.0 parts by weight, based on 100 parts by weight of the colored particles. When the amount is too small, the resultant toner has too small a charge to be practically used. When the amount is too large, fluidity of the resultant toner and developer deteriorate, resulting in deterioration of the resultant image density.

(External Additive)

The toner of the present invention may include particles of an inorganic material other than the large-sized silica particles having a number average primary particle diameter of from 80 to 200 nm mentioned above.

Specific examples of the inorganic material include, but are not limited to, silica, titanium oxide, alumina, barium titanate, magnesium titanate, calcium titanate, strontium titanate, iron oxide, copper oxide, zinc oxide, tin oxide, quartz sand, clay, mica, sand-lime, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride.

The inorganic material particles preferably have an average primary particle diameter of not greater than 30 nm, in terms of imparting fluidity to the resultant toner. In this case, the resultant toner has good fluidity and uniform chargeability, resulting in preventing the occurrence of toner scattering and background fouling.

Specific examples of useable commercially available hydrophobized silica particles having an average primary particle diameter of not greater than 30 nm include, but are not limited to, HDK H 2000, HDK H 2050EP, and HVK 21 (from Clariant Japan K. K.); R972, R974, RX200, RY200, R202, R805, and R812 (from Nippon Aerosil Co., Ltd.); and TS530 and TS720 (from Cabot Corporation).

Specific examples of useable commercially available titanium oxide particles include, but are not limited to, P-25 (from Nippon Aerosil Co., Ltd.); STT-30 and STT-65C-S (from Titan Kogyo K. K.); TAF-140 (from Fuji Titanium Industry Co., Ltd.); and MT-150W, MT-500B, and MT-600B (from Tayca Corporation).

Specific examples of useable commercially available hydrophobized titanium oxide particles include, but are not limited to, T-805 (from Nippon Aerosil Co., Ltd.); STT-30A and STT-65S-S (from Titan Kogyo K. K.); TAF-500T and TAF-1500T (from Fuji Titanium Industry Co., Ltd.); MT-100S and MT-100T (from Tayca Corporation); and IT-S (from Ishihara Sangyo Kaisha, Ltd.).

As mentioned above, these silica and/or titanium oxide particles may be used in combination with the above-mentioned large-sized silica particles having an average primary particle diameter of from 80 to 200 nm.

In the present invention, when the toner includes particles of a plurality of inorganic materials, these inorganic materials preferably have different average primary particle diameters. Since the inorganic material particles are externally mixed with toner particles, the inorganic material particles tend to be gradually buried in the toner particles by application of a load in the development process. When a toner includes particles of two kinds of inorganic materials, particles of an inorganic material having a larger average particle diameter function as a spacer between the surfaces of the toner particles and the surfaces of an image bearing member (i.e., a photoreceptor) and/or a carrier, so that particles of another inorganic material having a smaller average particle diameter are not buried in the surfaces of the toner particles. Therefore, the initial covering condition of the toner particles with the inorganic material particles is maintained for a long period of time, resulting in preventing the occurrence of the filming problem. This effect is easily obtainable when a silica and/or titanium oxide particles are used in combination with the above-mentioned large-sized silica particles having an average primary particle diameter of from 80 to 200 nm.

It is preferable that at least one of the inorganic materials used in the toner is hydrophobized with an organic silane compound. In this case, the resultant toner has good environmental stability and the resultant image has a high image quality without image defect. Of course, all of the inorganic material used in the toner may be hydrophobized.

Specific examples of the hydrophobizing agent include, but are not limited to, organic silane compounds (e.g., dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinyltrimethoxysilane, vinyl tris(β-methoxyethoxy)silane, γ-methacryloxypropyltrimethoxysilane, vinyltriacetoxysilane, divinyldichlorosilane, dimethylvinylchlorosilane, octyltrichlorosilane, decyltrichlorosilane, nonyltrichlorosilane, (4-t-propylphenyl)trichlorosilane, (4-t-butylphenyl) trichlorosilane, dipenthyldichlorosilane, dihexyldichlorosilane, dioctyldichlorosilane, dinonyldichlorosilane, didecyldichlorosilane, didodecyldichlorosilane, dihexadecyldichlorosilane, (4-t-butylphenyl)octyldichlorosilane, didecenyldichlorosilane, dinoneyldichlorosilane, di-2-ethylhexyldichlorosilane, di-3,3-dimethylpentyldichlorosilane, trihexylchlorosilane, trioctylchlorosilane, tridecylchlorosilane, dioctylmethylchlorosilane, octyldimethylchlorosilane, (4-t-propylphenyl)diethylchlorosilane, isobutyltrimethoxysilane, methyltrimethoxysilane, octyltrimethoxysilane, trimethoxy(3,3,3-trifluoropropyl)silane, hexamethyldisilazane, hexaethyldisilazane, diethyltetraethyldisilazane, hexaphenyldisilazane, hexatolyldisilazane), silicone oils (e.g., dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl-modified silicone oil, methacryl-modified silicone oil, α-methylstyrene-modified silicone oil), silylation agents, silane coupling agents having a fluorinated alkyl group, organic titanate coupling agents, and aluminum coupling agents. Among these, the organic silane compounds are preferably used.

The above-mentioned inorganic material particles may be treated with the above hydrophobizing agent to prepare hydrophobized particles of the inorganic materials.

The average primary particle diameter of the inorganic material particles can be measured by the aforementioned method.

(Colorant)

Specific examples of the colorants for use in the toner of the present invention include any known dyes and pigments such as carbon black, lampblack, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination.

(Other Additives)

The toner of the present invention may include other additives such as a wax.

Any known waxes can be used for the toner of the present invention. Specific examples of the wax include, but are not limited to, polyolefin waxes (e.g., polyethylene waxes, polypropylene waxes), hydrocarbons having a long chain (e.g., paraffin waxes, SASOL waxes), and waxes having a carbonyl group. Among these, waxes having a carbonyl group are preferably used.

Specific examples of the waxes having a carbonyl group include, but are not limited to, polyalkanoic acid esters (e.g., carnauba waxes, montan waxes, trimethylolpropane tribehenate, pentaerythritol tetrabehenate, pentaerythritol diacetate dibehenate, glycerin tribehenate, 1,18-octadecanediol distearate); polyalkanol esters (e.g., tristearyl trimellitate, distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkanoic acid esters are preferably used.

The wax typically has a melting point of from 40 to 160° C., preferably from 50 to 120° C., and more preferably from 60 to 90° C. When the melting point is too low, thermostable preservability of the resultant toner deteriorates. When the melting point is too high, the wax cannot assist toner particles to melt and fuse with each other when fixed at low temperatures.

The wax preferably has a melt viscosity of from 5 to 1,000 cps, and more preferably from 10 to 100 cps, when measured at a temperature 20° C. higher than the melting point of the wax. When the melt viscosity is too large, the wax cannot assist toner particles to melt and fuse with each other when fixed at low temperatures.

The toner of the present invention preferably has a ½ method melting temperature (to be explained in detail later), measured by a flowtester, of from 100 to 115° C., for use in non-contact fixing methods. It is important that the toner has a ½ method melting temperature of not greater than 115° C. When the ½ method melting temperature is too high, the fixation may be performed at an extremely high temperature, resulting in raising a possibility of causing an ignition of a transfer material. When the ½ method melting temperature is too low, the toner tends to cause a filming problem in which a toner forms films thereof on an image bearing member, a carrier, a development sleeve, etc. In order to prevent the occurrence of the filming problem, the toner preferably has a ½ method melting temperature of from 100 to 115° C., and more preferably from 105 to 110° C.

When a plurality of toners are used in an image, it is important that each of the toners has a difference in ½ method melting temperature of not greater than 10° C. from the other toners. When an image includes two or more toner layers having different colors, the adhesion property between the toner layers may be considered in addition to the fixation property of the toner layers to a transfer material. When the difference in ½ method melting temperature is not greater than 10° C., preferably not less than 7° C., the adhesion between the toner layers increases (i.e., the toner layers are prevented from being separated from each other). As a result, fixability and color reproducibility of the resultant toner may not deteriorate.

The ½-method melting temperature of the present invention is defined as the melting temperature measured by a ½ flow test method of a SHIMADZU FLOWTESTER CFT-500C (manufactured by Shimadzu Corporation).

FIG. 1 is an example of a flow curve obtained by the flowtester CFT-500C. The X-axis represents a temperature and the Y-axis represents a piston stroke. As illustrated in FIG. 1, a value of a point A on the Y-axis is the midpoint between Smax and 5 min. A value of the point A on the X-axis is defined as the ½ method melting temperature in the present invention.

The measurement conditions are as follows:

Cylinder pressure: 10.0 kgf/cm$^2$

Die length: 0.995 to 1.005 mm

Die orifice diameter: 0.049 to 0.051 mm

Start temperature: 50° C.

Temperature rising rate: 3.0° C./min

In order to prepare a measurement sample, 0.95 to 1.05 g of a toner is pelletized using a compacting machine including a piston having a diameter of 11.282 to 11.284 mm. The measurement sample is set in the flowtester and the ½ method melting temperature is measured under the above-mentioned conditions.

In the present invention, the circularity and the envelope degree of a toner are measured using a flow-type particle image analyzer FPIA-3000 (manufactured by Sysmex Corporation).

A typical measurement method is as follows:

(1) 0.1 to 0.5 ml of a surfactant (preferably alkylbenzene sulfonate) is included as a dispersant in 100 to 150 ml of water from which solid impurities have been removed;

(2) 0.1 to 0.5 g of a toner is added thereto and dispersed using an ultrasonic dispersing machine for about 1 to 3 minutes to prepare a toner suspension liquid including 3,000 to 10,000 per 1 micro-liter of the toner particles; and (3) the average circularity and circularity distribution of the toner are determined by the measuring instrument mentioned above.

The circularity of a particle is determined by the following equation:

$$\text{Circularity}=Cs/Cp$$

wherein Cp represents the length of the circumference of the image of a particle and Cs represents the length of the circumference of a circle having the same area as that of the image of the particle.

The ratio $R_A$, (% by number) of the number of toner particles A to the total number of toner particles included in a toner and the ratio $R_B$ (% by number) of the number of toner particles B to the total number of toner particles included in the toner are determined by the following equations:

$$R_A=(N_A/N_T)\times 100$$

$$R_B=(N_B/N_T)\times 100$$

wherein $N_A$ represents the number of toner particles A included in a toner, $N_B$ represents the number of toner particles B included in the toner, and $N_T$ represents the total number of toner particles included in the toner.

The standard deviation (SD) of circularity of the toner particles A is measured with specifying the measurement ranges of particle diameter (i.e., the diameter of a circle having the same area as that of a projected image of a particle) from 0.5 μm to 200.0 μm, and of circularity greater than 0.93 and not greater than 1.00.

The average envelope degree (ED) (based on area) of the toner particles B is determined by the following equation:

$$\text{ED (based on area)}=S_B/H_B$$

wherein $S_B$ and $H_B$ represent the average area and the average envelope area, respectively, of projected images of particles having a circularity of from 0.85 to 0.93.

Figure 2:
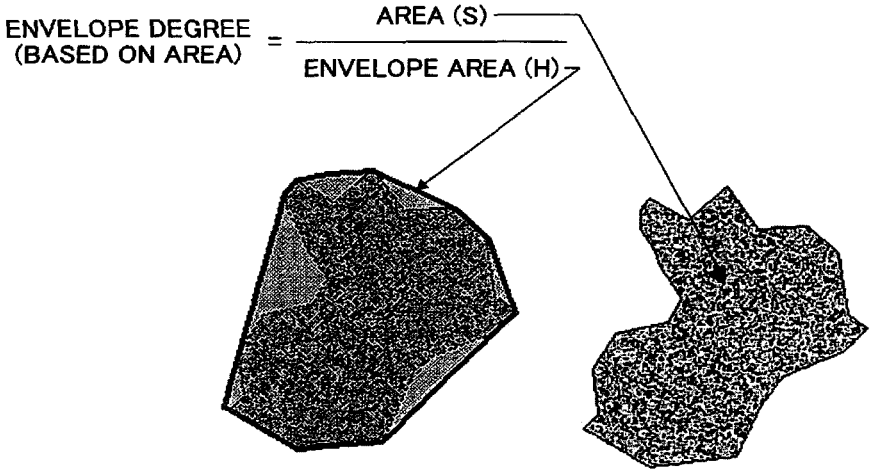
FIG. 2 is a schematic view for explaining how to determine the envelope degree (based on area) of a typical particle of the toner of the present invention.

As illustrated in FIG. 2, the envelope degree (based on area) is the ratio of the area (S) of a projected image of a particle to the envelope area (H) (i.e., an area of a polygon obtained by connecting convex portions of a projected image of a particle) thereof. Therefore, the ED represents a concavo-convex degree of a particle.

An example of a method for manufacturing the toner of the present invention will be explained.

At first, a binder resin (e.g., a polyol resin), a colorant (e.g., a pigment, a dye), a charge controlling agent, a wax, etc. are mixed using a mixer (e.g., HENSCHEL MIXER). When a toner for use in a full-color image is prepared, a colorant master batch in which a colorant and a part of a binder resin are previously melt-kneaded is typically used, to improve dispersibility of the colorant.

Next, the above-prepared mixture is melt-kneaded using a kneader such as a batch-type two-roll mill, a BANBURY MIXER, a continuous double-axis extruder (e.g., TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., KEX EXTRUDER from Kurimoto, Ltd.), or a continuous single-axis extruder (e.g., KOKNEADER from Buss Corporation).

The kneaded mixture is then cooled and coarsely pulverized using a hammer mill, etc.

The coarsely pulverized particles are then finely pulverized using a pulverizer using an air jet and/or a mechanical pulverizer. The pulverizer using an air jet is preferably used to prepare particles having a small particle diameter. The finely pulverized particles are then classified using a classifier using a rotational flow and/or a classifier using the Coanda effect. Thus, colored particles having a desired particle diameter are produced.

In the present invention, the above-prepared colored particles are preferably subjected to a surface treatment by flowing into a thermal current. The thermal current preferably has a temperature of 50 to 100° C., more preferably 60 to 90° C., higher than the ½ method melting temperature of the resin used. However, the temperature of the thermal current may be controlled according to the thermal properties of the resin used. When the temperature is too much lower than the ½ method melting temperature of the resin, concavities and convexities on the surfaces may be smoothened. As a result, the toner particles B of the present invention may not have a desired envelope degree, and therefore ultrafine particles tend to be produced when an external impact is applied. When the temperature is too much higher than the ½ method melting temperature of the resin, the particles may have a true spherical shape and a narrow shape distribution. In other words, the resultant toner may not have a desired circularity distribution, resulting in deterioration of chargeability (in particular, an ability to be quickly charged) and cleanability.

The above surface treatment may be performed using an apparatus such as METEORAINBOW from Nippon Pneumatic Mfg. Co., Ltd.

The colored particles are preferably mixed with an external additive using a mixer before being subjected to the surface treatment using a thermal current, in order to prevent the colored particles from melting and forming secondary aggregations.

Specific examples of the mixers include a V-form mixer, a locking mixer, a LOEDIGE Mixer, a NAUTA MIXER, a HENSCHEL MIXER, a SUPER MIXER and the like mixers. These mixers are preferably equipped with a jacket so that the inner temperature can be controlled.

By mixing an external additive with the colored particles before being subjected to the surface treatment using a thermal current, the shapes of the colored particles can be controlled because the external additive may prevent the colored particles from melting. When the amount of the external additive is too small, the colored particles tend to have a spherical shape and a narrow particle shape distribution. Therefore, 100 parts by weight of the colored particles are preferably mixed with 0.05 to 1.0 parts by weight, more preferably 0.1 to 0.5 parts by weight, of the external additive.

If the external additive strongly fixes onto the surfaces of the colored particles and cannot exert its effect due to the thermal treatment, the external additive may be mixed with the colored particles after the thermal treatment.

The toner of the present invention can be used for a two-component developer including a toner and a magnetic carrier. The two-component developer preferably includes 1 to 10 parts by weight of the toner based on 100 parts by weight of the carrier.

Specific examples of the magnetic carrier include, but are not limited to, iron powders, ferrite powders, magnetite powders, and a magnetic resin carrier, which have a particle diameter of from 20 to 200 μm. These can be covered with a covering material. Specific examples of the covering material include, but are not limited to, amino resins (e.g., urea-formaldehyde resin, melamine resin, benzoguanamine resin, urea resin, polyamide resin, epoxy resin), polyvinyl and polyvinylidene resins (e.g., acrylic resin, polymethyl methacrylate resin, polyacrylonitrile resin, polyvinyl acetate resin, polyvinyl alcohol resin, polyvinyl butyral resin), polystyrene resins (e.g., polystyrene resin, styrene-acrylic copolymer resin), halogenated olefin resins (e.g., polyvinyl chloride), polyester resins (e.g., polyethylene terephthalate resin, polybutylene terephthalate resin), polycarbonate resins, polyethylene resins, polyvinyl fluoride resins, polyvinylidene fluoride resins, polytrifluoroethylene resins, polyhexafluoropropylene resins, copolymers of vinylidene fluoride and an acrylic monomer, copolymers of vinylidene fluoride and vinyl fluoride, fluoroterpolymers (e.g., terpolymers of tetrafluoroethylene, vinylidene fluoride, and a non-fluoro monomer), and silicone resins.

The covering material optionally includes powders of a conductive material, if desired. Specific examples of the conductive material include, but are not limited to, carbon black, titanium oxide, tin oxide, and zinc oxide. The powders of the conductive material preferably have an average particle diameter of not greater than 1 μm. When the particle diameter is too large, it is difficult to control the electric resistivity of the resultant carrier.

(Image Forming Method)

The image forming method of the present invention includes:

forming an electrostatic latent image on an electrostatic latent image bearing member;

developing the electrostatic latent image with the toner of the present invention;

transferring the toner image onto a recording medium; and fixing the toner image on the recording medium by a non-contact fixing means.

According to the present invention, an image forming method capable of simultaneous duplex printing (copying) with a simple apparatus may be provided when a continuous transfer material is used as the recording medium in the above image forming method. In particular, the continuous transfer material drives the image bearing member by tightly winding thereon while forming an image on the transfer material, and the image is fixed by a non-contact heating method. In the present invention, "transfer material" includes a medium on which a toner image is directly transferred from an electrostatic latent image member and fixed. Specifically, papers and OHP sheets are used as the transfer material.

Figure 3:
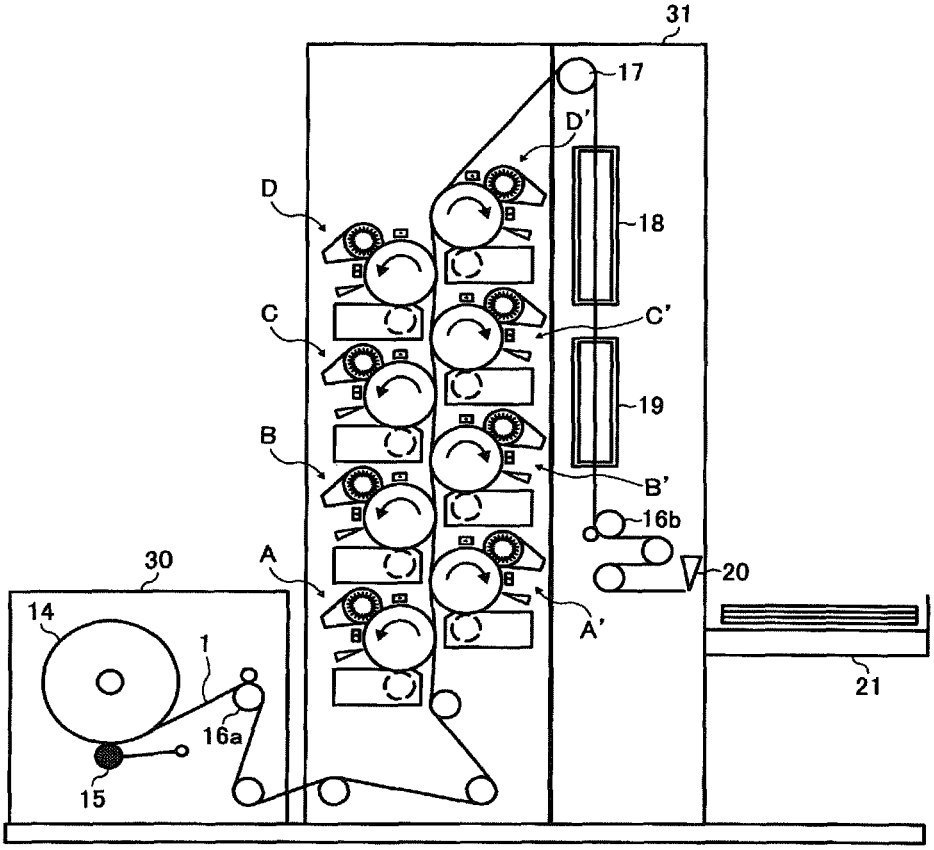
FIG. 3 is a schematic view illustrating an embodiment of an image forming apparatus using the image forming method of the present invention.

FIG. 3 is a schematic view illustrating an embodiment of an image forming apparatus using the image forming method of the present invention. As illustrated in FIG. 3, rotatable electrostatic latent image bearing members are preferably in a zigzag arrangement.

A supply station 30 contains a supply roller 14 on which a continuous paper 1 is wound. The continuous paper 1 is transported to a printing housing 31 containing image forming stations A, B, C, D, A', B', C', and D', each having the same configuration. The image forming stations A, B, C, and D are configured to print yellow, magenta, cyan, and black images, respectively. The image forming stations A', B', C', and D' are configured to print yellow, magenta, cyan, and black images, respectively. A group of image forming stations A, B, C, and D and another group of image forming stations A', B', C', and D' each are vertically structured, resulting in reducing the footprint.

The continuous paper 1 is released from the supply roller 14 and transported upward, and subsequently passes the image forming stations. A brake 15 acts on the supply roller 14. After the continuous paper 1 passes the last image forming station D', the continuous paper 1 passes a reverse roller 17 and is transported downward, and subsequently passes an image fixing station 18, a cooling station 19, and a cutting station 20. The continuous paper 1 is cut into sheets, and the sheets are stacked on a stacker 21. The continuous paper 1 is transported by driving rollers 16*a* and 16*b* throughout the apparatus. The driving roller 16*a* is provided between the supply station 30 and the first image forming station A, and the driving roller 16*b* is provided between the cooling station 19 and the cutting station 20. The driving rollers 16*a* and 16*b* are driven by controllable motors (not shown).

Figure 4:
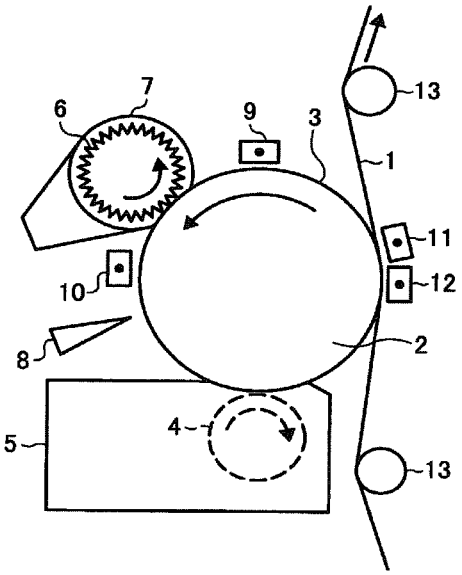
FIG. 4 is a magnified schematic view illustrating an embodiment of the image forming station of the image forming apparatus illustrated in FIG. 3.

FIG. 4 is a magnified schematic view illustrating an embodiment of the image forming station of the image forming apparatus illustrated in FIG. 3.

The image forming station includes a cylindrical drum 2 having a photosensitive outer surface 3. Around the cylindrical drum 2, a corotron or scorotron charger 10 configured to uniformly charge the photosensitive outer surface 3 and an irradiator 8 configured to irradiate the photosensitive outer surface 3 with a scanning laser beam or an LED array are provided along the photosensitive outer surface 3. The photosensitive outer surface 3 is irradiated in an image direction or a line direction so that the charges on the photosensitive outer surface 3 are selectively removed to form a latent image. The latent image becomes visible by contacting a developing member to the photosensitive outer surface 3 in a developing station 5. The developing station 5 includes a developing drum 4 installed controllably. The developing drum 4 may radially move toward or away from the cylindrical drum 2. Since the developing drum 4 contains a magnet in a rotating sleeve thereof, a mixture of toner particles and magnetizable carrier particles are rotated together with the rotating sleeve and form a magnetic brush on the developing drum 4. The magnetic brush contacts the photosensitive outer surface 3 on the cylindrical drum 2. The negatively charged toner particles are attracted to the irradiated portion of the photosensitive outer surface 3 due to an electric field formed between the irradiated portion and the developing member negatively biased. Thus, the latent image becomes visible, i.e., a toner image is formed.

The toner image formed on the photosensitive outer surface 3 is transferred onto the continuous paper 1 by a transfer corona charger 12.

The transfer corona charger 12 is provided opposite to the cylindrical drum 2 across the continuous paper 1. The toner particles are detached from the photosensitive outer surface 3 and attracted to the surface of the continuous paper 1 due to a high potential of the transfer corona charger 12 having reverse polarity to the toner particles. The transfer corona charger 12 functions between the continuous paper 1 and the photosensitive outer surface 3 so that a strong adsorbability is generated therebetween. Thereby, the photosensitive outer surface 3 rotates in synchronization with a movement of the continuous paper 1. As a result, the toner particles are tightly adhered to the surface of the continuous paper 1. However, the continuous paper 1 should not adhere to the photosensitive outer surface 3 beyond the positions where guide rollers 13 are provided. Therefore, a discharge corona charger 11 is provided on a position beyond the transfer corona charger 12 along the photosensitive outer surface 3. The discharge corona charger 11 is driven by an alternating current so that the continuous paper 1 is discharged and detached from the photosensitive outer surface 3.

The photosensitive outer surface 3 is subsequently pre-charged by a corotron or scorotron pre-charger 9. Residual toner particles remaining on the photosensitive outer surface 3 are removed by a cleaning unit 7. The cleaning unit 7 includes a cleaning brush 6 installed controllably. The cleaning brush 6 may radially move toward or away from the photosensitive outer surface 3. The cleaning brush 6 may be grounded, or detached from the photosensitive outer surface 3 and applying a potential thereto, so that the residual toner particles are attracted to the cleaning brush 6. The photosensitive outer surface 3 is prepared for a next image forming operation after being cleaned.

(Process Cartridge)

The process cartridge of the present invention includes an electrostatic latent image bearing member and a development means for developing an electrostatic latent image formed on the electrostatic latent image bearing member to form a visible image, and optionally includes a charging means, an irradiating means, a transfer means, a cleaning means, a discharge means, etc., if desired.

The process cartridge of the present invention may be detachably attached to an image forming apparatus.

Figure 5:
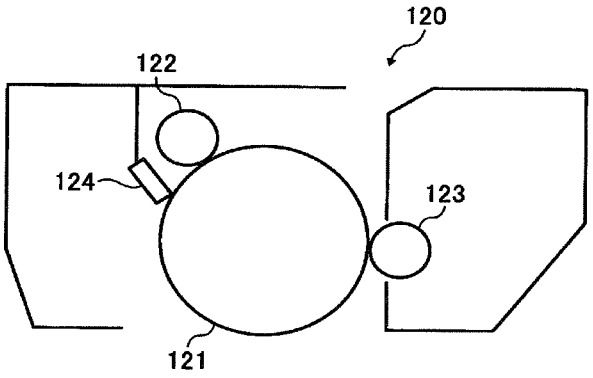
FIG. 5 is a schematic view illustrating an embodiment of the process cartridge of the present invention.

FIG. 5 is a schematic view illustrating an embodiment of the process cartridge of the present invention. A process cartridge 120 includes a photoreceptor 121, a charger 122, a developing device 123, and a cleaning device 124.

Next, an image forming method of an image forming apparatus including the process cartridge 120 will be explained. The photoreceptor 121 rotates at a predetermined speed, and the surface thereof is charged by the charger 122 to reach a positive or negative predetermined potential while rotating. The photoreceptor 121 is irradiated with a light containing image information emitted by a light irradiator such as a slit irradiator and a laser beam scanning irradiator, to form an electrostatic latent image thereon. The electrostatic latent image is developed with a toner in the developing device 123, and then the toner image is transferred onto a transfer material which is timely fed from a feeding part to an area formed between the photoreceptor 121 and the transfer device so as to meet the toner images on the photoreceptor 121. The transfer material having the toner images thereon is separated from the photoreceptor 121 and transported to a fixing device so that the toner image is fixed and discharged from the image forming apparatus as a copying or a printing. After the toner image is transferred, residual toner particles remaining on the photoreceptor are removed using the cleaning device 124, and then the photoreceptor is discharged. The photoreceptor 121 is used repeatedly.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Toner Manufacturing Example 1

The following components were mixed using a flasher.

Water 600 parts

Wet cake of Pigment Blue 15:3 1200 parts (solid content: 50%)

The mixture was mixed with 1200 parts of a polyol resin (formed from a condensation reaction among an epoxy resin, bisphenol A, p-cumylphenol, and an alkylene oxide-modified epoxy resin, having a number average molecular weight (Mn) of 3000, a weight average molecular weight (Mw) of 15000, and a glass transition temperature (Tg) of 60° C.), and then kneaded for 30 minutes at 150° C. The water was removed therefrom. The kneaded mixture was drawn and cooled, and then pulverized using a pulverizer. The pulverized particles were passed through a triple-roll mill twice. Thus, a pigment master batch was prepared.

Next, the following components were mixed using a mixer.

| | |
|---|---|
| Polyol resin<br>(Mn: 3,000, Mw: 15,000, Tg: 60° C.) | 96.0 parts |
| Pigment Master Batch (prepared above) | 8.0 parts |
| Charge controlling agent<br>(E-84 (a zinc salt of 3,5-di-tert-butyl salicylic acid) from Orient Chemical Industries, Ltd.) | 2.0 parts |

The mixture was melt-kneaded using a two-roll mill. The kneaded mixture was drawn and cooled, and then pulverized using a TURBO COUNTER JET MILL (from Turbo Kogyo Co., Ltd.). The pulverized particles were classified using a DS classifier (from Nippon Pneumatic Mfg. Co., Ltd.). Thus, colored particles having a volume average particle diameter of 8.8 μm were prepared.

The following materials were mixed with 100 parts by weight of the above-prepared colored particles using a HENSCHEL MIXER.

| | |
|---|---|
| Hydrophobized silica particles<br>(average primary particle diameter: 20 nm) | 0.20 parts |
| Titanium oxide particles<br>(average primary particle diameter:15 nm) | 0.20 parts |

A mixing operation, in which the revolution was 1890 rpm, the mixing time was 30 seconds, and the rest time was 60 seconds, was performed 5 times.

The mixed particles were thermally treated using a METEORAINBOW MR10 (from Nippon Pneumatic Mfg. Co., Ltd.) at a feed quantity of 5 kg/hr and a treatment temperature of 170° C. Thus, surface-treated colored particles were prepared.

Next, 100 parts of the surface-treated colored particles were mixed with 0.20 parts of hydrophobized silica particles (having an average primary diameter of 20 nm) using a HENSCHEL MIXER. A mixing operation, in which the revolution was 1890 rpm, the mixing time was 30 seconds, and the rest time was 60 seconds, was performed 5 times. Thus, a cyan toner (1) was prepared.

Figure 6:
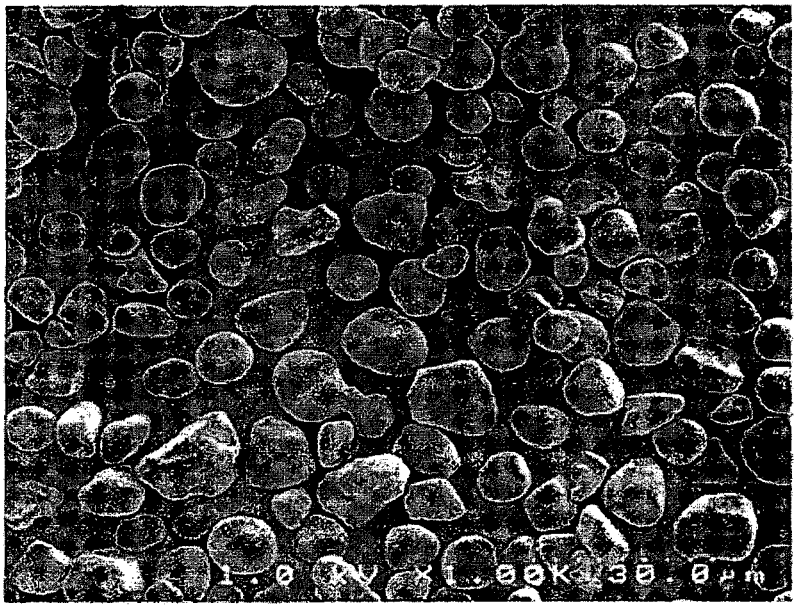
FIG. 6 is a SEM image (×1,000) of the toner of the present invention.

The cyan toner (1) has a volume average particle diameter of 8.8 μm and a ½ method melting temperature of 110° C. The toner shape measured by FPIA-3000 is shown in Table 1. The SEM image (×1,000) of the toner is shown in FIG. 6. It is clear from FIG. 6 that the cyan toner (1) includes various shaped particles (e.g., a spherical shape, a bell-like cone shape, a flat shape). Among these particles, particles being relatively not spherical (i.e., toner particles B) have a few concavities and convexities on the surfaces thereof.

Carrier Manufacturing Example 1

The following components were dispersed using a HOMOMIXER for 30 minutes to prepare a cover layer formation liquid.

| | |
|---|---|
| Silicone resin solution<br>(KR 50 from Shin-Etsu Chemical Co., Ltd.) | 100 parts |
| γ-(2-Aminoethyl) aminopropyl trimethoxysilane | 3 parts |
| Toluene | 100 parts |

The thus prepared cover layer formation liquid was applied to the surface of 1000 parts of a spherical ferrite having an average particle diameter of 55 μm using a fluidized-bed application device. Thus, a carrier (A) having a cover layer was prepared.

(Evaluation)

At first, 2325 g of the carrier (A) and 175 g of the cyan toner (1) were mixed using a TURBLER® MIXER to prepare a two-component developer having a toner concentration of 7% by weight. The two-component developer was set in a printing station of XEIKON 6000 (from Punch Graphix), which adopts an image forming method in which a continuous transfer material drives an image bearing member by tightly winding thereon while forming an image on the transfer material, and the image is fixed by a non-contact heating method. The cyan toner (1) was set in a toner supplying part. A continuous paper having a basis weight of 190 g/m$^2$ was set in a paper feeding part. Images were produced at a feeding speed of 120 mm/sec and a temperature of a fixing station of 130° C.

The development conditions (LDA setting) of XEIKON 6000 were controlled so that the produced solid image has an image density of 1.40 (measured by D19C equipped with a filter 47B, from Gretag Macbeth). A running test in which 10,000 copies of a half-tone image having an image proportion of 10% were produced was performed after being kept in conditions of 23° C. and 50% RH for a night.

The following evaluations were performed after the running test, if not otherwise specified. The evaluation results are shown in Table 2.

(1) Evaluation of Smudge on Edge Portion

A solid image of an isosceles triangle, with the base having a length of 12 mm and the height having a length of 38 mm, was produced. The edge portion of the tip of the image was visually observed and evaluated as follows.

Rank 5: Very good (No smudge was observed.)

Rank 4: Good (Smudge were slightly observed.)

Rank 3: Acceptable (Smudge were observed, but the image is acceptable.)

Rank 2: Poor (Smudge were observed, and the image was not acceptable.)

Rank 1: Very poor (Smudge were extremely observed.)

(2) Evaluation of Background Fouling

After 2,000 copies of a solid image having an image proportion of 70% were produced, a thin line image having an image proportion of 1% was successively produced. The background portion of the thin line image was visually observed using a loupe and evaluated as follows.

Rank 5: No background fouling was observed.

Rank 4: Background fouling was slightly observed.

Rank 3: Background fouling was observed, but the image is acceptable.

Rank 2: Background fouling was observed, and the image is not acceptable.

Rank 1: Severe background fouling was observed.

(3) Evaluation of Durability

The charge quantity (Q/M (−μC/g)) of the developer and the image quality (e.g., transfer defect, dot reproducibility) were determined after the running test was performed, and compared with those in the initial conditions to evaluate the durability. The charge quantity of the developer was measured by a blow-off method at conditions of 23° C. and 50% RR. The durability was evaluated as follows.

Rank 5: Q/M was not changed.

Rank 4: Q/M was decreased, but the image quality was not changed.

Rank 3: Q/M was decreased and background fouling was observed, but the image was acceptable.

Rank 2: Q/M was decreased and background fouling was observed, and the image was not acceptable.

Rank 1: Q/M was extremely decreased, and the image was not acceptable.

(4) Evaluation of Thermostable Preservability

A 50 ml glass container was filled with the toner, and kept in a thermostatic chamber for 20 hours at 50° C. The toner was then cooled to room temperature, and subjected to a penetrating test (based on JIS K2235-1991). The thermostable preservability was evaluated as follows.

Rank 5: The penetration depth was not less than 25 mm.

Rank 4: The penetration depth was from 20 to 25 mm.

Rank 3: The penetration depth was from 15 to 20 mm. Acceptable.

Rank 2: The penetration depth was from 10 to 15 mm. Not acceptable.

Rank 1: The penetration depth was not greater than 10 mm. Not acceptable.

Example 2

Toner Manufacturing Example 2

The following materials were mixed with 100 parts by weight of the colored particles having a volume average particle diameter of 8.8 μm, prepared in Toner Manufacturing Example 1, using a HENSCHEL MIXER.

| | |
|---|---|
| Hydrophobized silica particles (average primary particle diameter: 20 nm) | 0.40 parts |
| Titanium oxide particles (average primary particle diameter: 15 nm) | 0.20 parts |

A mixing operation, in which the revolution was 1890 rpm, the mixing time was 30 seconds, and the rest time was 60 seconds, was performed 5 times.

The mixed particles were thermally treated using a METEORAINBOW MR10 (from Nippon Pneumatic Mfg. Co., Ltd.) at a feed quantity of 5 kg/hr and a treatment temperature of 170° C. Thus, surface-treated colored particles were prepared.

Next, 100 parts of the surface-treated colored particles were mixed with 0.20 parts of hydrophobized silica particles (having an average primary diameter of 20 nm) using a HENSCHEL MIXER. A mixing operation, in which the revolution was 1890 rpm, the mixing time was 30 seconds, and the rest time was 60 seconds, was performed 5 times. Thus, a cyan toner (2) was prepared.

The cyan toner (2) has a volume average particle diameter of 8.8 μm and a ½ method melting temperature of 110° C. The toner shape measured by FPIA-3000 is shown in Table 1.

(Evaluation)

At first, 2325 g of the carrier (A) and 175 g of the cyan toner (2) were mixed using a TURBLER® MIXER to prepare a two-component developer having a toner concentration of 7% by weight. The two-component developer was set in a printing station of XEIKON 6000 (from Punch Graphix). The cyan toner (2) was set in a toner supplying part. A continuous paper having a basis weight of 190 g/m$^2$ was set in a paper feeding part. Images were produced at a feeding speed of 120 mm/sec and a temperature of a fixing station of 130° C.

The evaluations performed in Example 1 were repeated. The evaluation results are shown in Table 2.

Example 3

Toner Manufacturing Example 3

The following materials were mixed with 100 parts by weight of the colored particles having a volume average particle diameter of 8.8 μm, prepared in Toner Manufacturing Example 1, using a HENSCHEL MIXER.

| | |
|---|---|
| Hydrophobized silica particles (average primary particle diameter: 20 nm) | 0.40 parts |
| Titanium oxide particles (average primary particle diameter: 15 nm) | 0.30 parts |

A mixing operation, in which the revolution was 1890 rpm, the mixing time was 30 seconds, and the rest time was 60 seconds, was performed 5 times.

The mixed particles were thermally treated using a METEORAINBOW MR10 (from Nippon Pneumatic Mfg. Co., Ltd.) at a feed quantity of 5 kg/hr and a treatment temperature of 190° C. Thus, surface-treated colored particles were prepared.

Next, 100 parts of the surface-treated colored particles were mixed with 0.20 parts of hydrophobized silica particles (having an average primary diameter of 20 nm) using a HENSCHEL MIXER. A mixing operation, in which the revolution was 1890 rpm, the mixing time was 30 seconds, and the rest time was 60 seconds, was performed 5 times. Thus, a cyan toner (3) was prepared.

The cyan toner (3) has a volume average particle diameter of 8.8 μm and a ½ method melting temperature of 110° C. The toner shape measured by FPIA-3000 is shown in Table 1.

(Evaluation)

At first, 2325 g of the carrier (A) and 175 g of the cyan toner (3) were mixed using a TURBLER® MIXER to prepare a two-component developer having a toner concentration of 7% by weight. The two-component developer was set in a printing station of XEIKON 6000 (from Punch Graphix). The cyan toner (3) was set in a toner supplying part. A continuous paper having a basis weight of 190 g/m$^2$ was set in a paper feeding part. Images were produced at a feeding speed of 120 mm/sec and a temperature of a fixing station of 130° C.

The evaluations performed in Example 1 were repeated. The evaluation results are shown in Table 2.

Example 4

Toner Manufacturing Example 4

The following materials were mixed with 100 parts by weight of the colored particles having a volume average particle diameter of 8.8 μm, prepared in Toner Manufacturing Example 1, using a HENSCHEL MIXER.

| | |
|---|---|
| Hydrophobized silica particles (average primary particle diameter: 20 nm) | 0.20 parts |
| Titanium oxide particles (average primary particle diameter: 15 nm) | 0.30 parts |

A mixing operation, in which the revolution was 1890 rpm, the mixing time was 30 seconds, and the rest time was 60 seconds, was performed 5 times.

The mixed particles were thermally treated using a METEORAINBOW MR10 (from Nippon Pneumatic Mfg. Co., Ltd.) at a feed quantity of 5 kg/hr and a treatment temperature of 180° C. Thus, surface-treated colored particles were prepared.

Next, 100 parts of the surface-treated colored particles were mixed with 0.20 parts of hydrophobized silica particles (having an average primary diameter of 20 nm) using a HENSCHEL MIXER. A mixing operation, in which the revolution was 1890 rpm, the mixing time was 30 seconds, and the rest time was 60 seconds, was performed 5 times. Thus, a cyan toner (4) was prepared.

The cyan toner (4) has a volume average particle diameter of 8.8 μm and a ½ method melting temperature of 110° C. The toner shape measured by FPIA-3000 is shown in Table 1.

(Evaluation)

At first, 2325 g of the carrier (A) and 175 g of the cyan toner (4) were mixed using a TURBLER® MIXER to prepare a two-component developer having a toner concentration of 7% by weight. The two-component developer was set in a printing station of XEIKON 6000 (from Punch Graphix). The cyan toner (4) was set in a toner supplying part. A continuous paper having a basis weight of 190 g/m$^2$ was set in a paper feeding part. Images were produced at a feeding speed of 120 mm/sec and a temperature of a fixing station of 130° C.

The evaluations performed in Example 1 were repeated. The evaluation results are shown in Table 2.

Example 5

Manufacturing Example of Large-Sized Silica

A distilled methyltrimethoxysilane was heated and nitrogen gas was bubbled therein. The methyltrimethoxysilane was introduced to an oxyhydrogen flame burner together with the nitrogen gas, and burned and decomposed therein. The added amounts of the methyltrimethoxysilane, oxygen gas, hydrogen gas, and nitrogen gas were 1270 g/hr, 2.9 Nm$^3$/hr, 2.1 Nm$^3$/hr, and 0.58 Nm$^3$/hr, respectively. The resultant spherical silica particles were collected using a bag filter.

Next, 1 kg of the spherical silica particles were fed into a 5-liter planetary mixer, and 10 g of pure water was added thereto while being agitated. The mixer was hermetically sealed and the mixture was agitated for 14 hours at 55° C. The mixture was cooled to room temperature, and 20 g of hexamethyldisilazane was added thereto while being agitated. The mixer was hermetically sealed again and the mixture was agitated for 24 hours. The mixture was heated to 115° C. and aerated to nitrogen gas so that the residual raw materials and the produced ammonia were removed. Thus, large-sized silica particles were prepared.

The large-sized silica particles have a number average primary particle diameter (R) of 110 nm, a standard deviation (σ) of primary particle diameter of 50 nm, a SF-1 of 120, and a SF-2 of 109.

Toner Manufacturing Example 5

The following materials were mixed with 100 parts by weight of the surface-treated colored particles prepared in Toner Manufacturing Example 4 using a HENSCHEL MIXER.

| | |
|---|---|
| Hydrophobized silica particles (average primary particle diameter: 20 nm) | 0.10 parts |
| Large-sized silica particles (average primary particle diameter: 110 nm) | 0.20 parts |

A mixing operation, in which the revolution was 1890 rpm, the mixing time was 30 seconds, and the rest time was 60 seconds, was performed 5 times. Thus, a cyan toner (5) was prepared.

The cyan toner (5) has a volume average particle diameter of 8.8 μm and a ½ method melting temperature of 110° C. The toner shape measured by FPIA-3000 is shown in Table 1.

(Evaluation)

At first, 2325 g of the carrier (A) and 175 g of the cyan toner (5) were mixed using a TURBLER® MIXER to prepare a two-component developer having a toner concentration of 7% by weight. The two-component developer was set in a printing station of XEIKON 6000 (from Punch Graphix). The cyan toner (5) was set in a toner supplying part. A continuous paper having a basis weight of 190 g/m$^2$ was set in a paper feeding part. Images were produced at a feeding speed of 120 mm/sec and a temperature of a fixing station of 130° C.

The evaluations performed in Example 1 were repeated. The evaluation results are shown in Table 2.

Comparative Example 1

Toner Manufacturing Example 6

The following components were mixed using a flasher.

| | |
|---|---|
| Water | 600 parts |
| Wet cake of Pigment Blue 15:3 (solid content: 50%) | 1200 parts |

The mixture was mixed with 1200 parts of a polyol resin (having a number average molecular weight (Mn) of 3000, a weight average molecular weight (Mw) of 15000, and a glass transition temperature (Tg) of 60° C.), and then kneaded for 30 minutes at 150° C. The water was removed therefrom. The kneaded mixture was drawn and cooled, and then pulverized using a pulverizer. The pulverized particles were passed through a triple-roll mill twice. Thus, a pigment master batch was prepared.

Next, the following components were mixed using a mixer.

| | |
|---|---|
| Polyol resin (Mn: 3,000, Mw: 15,000, Tg: 60° C.) | 96.0 parts |
| Pigment Master Batch (prepared above) | 8.0 parts |

-continued

| | |
|---|---|
| Charge controlling agent (E-84 (a zinc salt of 3,5-di-tert-butyl salicylic acid) from Orient Chemical Industries, Ltd.) | 2.0 parts |

The mixture was melt-kneaded using a two-roll mill. The kneaded mixture was drawn and cooled, and then pulverized using a TURBO COUNTER JET MILL (from Turbo Kogyo Co., Ltd.). The pulverized particles were classified using a DS classifier (from Nippon Pneumatic Mfg. Co., Ltd.). Thus, colored particles having a volume average particle diameter of 8.8 μm were prepared.

The following materials were mixed with 100 parts by weight of the above-prepared colored particles using a HENSCHEL MIXER.

| | |
|---|---|
| Hydrophobized silica particles (average primary particle diameter: 20 nm) | 0.40 parts |
| Titanium oxide particles (average primary particle diameter: 15 nm) | 0.20 parts |

A mixing operation, in which the revolution was 1890 rpm, the mixing time was 30 seconds, and the rest time was 60 seconds, was performed 5 times. Thus, a cyan toner (6) was prepared.

The cyan toner (6) has a volume average particle diameter of 8.8 μm and a ½ method melting temperature of 109° C. The toner shape measured by FPIA-3000 is shown in Table 1.

(Evaluation)

At first, 2325 g of the carrier (A) and 175 g of the cyan toner (6) were mixed using a TURBLER® MIXER to prepare a two-component developer having a toner concentration of 7% by weight. The two-component developer was set in a printing station of XEIKON 6000 (from Punch Graphix). The cyan toner (6) was set in a toner supplying part. A continuous paper having a basis weight of 190 g/m$^2$ was set in a paper feeding part. Images were produced at a feeding speed of 120 mm/sec and a temperature of a fixing station of 130° C.

The evaluations performed in Example 1 were repeated. The evaluation results are shown in Table 2.

Comparative Example 2

Toner Manufacturing Example 7

In a reaction vessel, 750 parts of ion-exchanged water and 500 parts of a 0.1 M aqueous solution of $Na_3PO_4$ were contained. The mixture was heated to 65° C. and agitated using TK HOMO MIXER® (from Tokushu Kika Kogyo Co., Ltd.) at a revolution of 12000 rpm. Next, 85 parts of a 1.5 M aqueous solution of $CaCl_2$ was gradually added thereto. Thus, an aqueous medium containing $Ca_3(PO_4)_2$ was prepared.

In another reaction vessel, the following components were contained.

| | |
|---|---|
| Styrene | 165.0 parts |
| n-Butyl acrylate | 34.0 parts |
| Colorant (C.I. Pigment Blue 15:3) | 13.0 parts |
| Polar resin (Polyester resin) | 15.0 parts |
| Charge controlling agent (E-84 from Orient Chemical Industries, Ltd.) | 3.0 parts |
| Cross-linker (Divinylbenzene) | 0.4 parts |

The mixture was heated to 65° C. and mixed using TK HOMO MIXER® (from Tokushu Kika Kogyo Co., Ltd.) at a revolution of 12000 rpm.

Further, 12 parts of a polymerization initiator 2,2'-azobis (2,4-dimethylvaleronitrile) was dissolved therein. Thus, a monomer composition was prepared.

The monomer composition was poured into the aqueous medium prepared above, and then the mixture was agitated for 5 minutes at 65° C. using TK HOMO MIXER® (from Tokushu Kika Kogyo Co., Ltd.) at a revolution of 10000 rpm under $N_2$ atmosphere so that the monomer composition was granulated. The mixture was further subjected to a reaction for 6 hours at 65° C. and 10 hours at 85° C. while agitated by paddle agitation blades.

After the reaction was terminated, the reaction vessel was cooled. Hydrochloric acid was added thereto, and calcium phosphate was dissolved therein. The mixture was filtered, washed with water, and dried. Thus, colored particles were prepared.

The following materials were mixed with 100 parts by weight of the above-prepared colored particles using a HENSCHEL MIXER.

| | |
|---|---|
| Hydrophobized silica particles (average primary particle diameter: 20 nm) | 0.40 parts |
| Titanium oxide particles (average primary particle diameter: 15 nm) | 0.20 parts |

A mixing operation, in which the revolution was 1890 rpm, the mixing time was 30 seconds, and the rest time was 60 seconds, was performed 5 times. Thus, a cyan toner (7) was prepared.

The cyan toner (7) has a volume average particle diameter of 7.5 μm and a ½ method melting temperature of 115° C. The toner shape measured by FPIA-3000 is shown in Table 1.

(Evaluation)

At first, 2325 g of the carrier (A) and 175 g of the cyan toner (7) were mixed using a TURBLER® MIXER to prepare a two-component developer having a toner concentration of 7% by weight. The two-component developer was set in a printing station of XEIKON 6000 (from Punch Graphix). The cyan toner (7) was set in a toner supplying part. A continuous paper having a basis weight of 190 g/m$^2$ was set in a paper feeding part. Images were produced at a feeding speed of 120 mm/sec and a temperature of a fixing station of 130° C.

The evaluations performed in Example 1 were repeated. The evaluation results are shown in Table 2.

Comparative Example 3

The following materials were mixed using a HENSCHEL MIXER.

| | |
|---|---|
| Colored particles prepared in Toner Manufacturing Example | 30.0 parts |
| Colored particles prepared in Toner Manufacturing Example | 70.0 parts |
| Hydrophobized silica particles (average primary particle diameter: 20 nm) | 0.40 parts |
| Titanium oxide particles (average primary particle diameter: 15 nm) | 0.20 parts |

A mixing operation, in which the revolution was 1890 rpm, the mixing time was 30 seconds, and the rest time was 60 seconds, was performed 5 times. Thus, a cyan toner (8) was prepared.

The cyan toner (8) has a volume average particle diameter of 7.9 μm and a ½ method melting temperature of 113° C. The toner shape measured by FPIA-3000 is shown in Table 1.

(Evaluation)

At first, 2325 g of the carrier (A) and 175 g of the cyan toner (8) were mixed using a TURBLER® MIXER to prepare a two-component developer having a toner concentration of 7% by weight. The two-component developer was set in a printing station of XEIKON 6000 (from Punch Graphix). The cyan toner (8) was set in a toner supplying part. A continuous paper having a basis weight of 190 g/m$^2$ was set in a paper feeding part. Images were produced at a feeding speed of 120 mm/sec and a temperature of a fixing station of 130° C.

The evaluations performed in Example 1 were repeated. The evaluation results are shown in Table 2.

TABLE 1

| | Toner particles A | | Toner particles B | | |
|---|---|---|---|---|---|
| | $R_A$(*) (% by number) | SD(**) | $R_B$(*) (% by number) | ED(***) | ½ method melting temperature (° C.) |
| Ex. 1 | 71.0 | 0.014 | 29.0 | 0.941 | 110 |
| Ex. 2 | 72.5 | 0.025 | 27.5 | 0.940 | 110 |
| Ex. 3 | 93.5 | 0.025 | 6.5 | 0.950 | 110 |
| Ex. 4 | 74.8 | 0.014 | 25.2 | 0.948 | 110 |
| Ex. 5 | 74.8 | 0.014 | 25.2 | 0.948 | 110 |
| Comp. Ex. 1 | 58.0 | 0.017 | 37.0 | 0.936 | 109 |
| Comp. Ex. 2 | 97.7 | 0.012 | 2.3 | 0.966 | 115 |
| Comp. Ex. 3 | 83.5 | 0.020 | 16.5 | 0.938 | 113 |

(*)$R_A$, $R_B$: Ratio of the number of toner particles A and B, respectively, to the total number of toner particles included in a toner
(**) SD: Standard deviation of circularity of toner particles A
(***) ED: Average envelope degree (based on area) of toner particles B

TABLE 2

| | Smudge on edge portion | Background fouling | Durability | Thermostable preservability |
|---|---|---|---|---|
| Ex. 1 | 5 | 5 | 4 | 3 |
| Ex. 2 | 5 | 5 | 4 | 3 |
| Ex. 3 | 5 | 4 | 5 | 3 |
| Ex. 4 | 5 | 4 | 5 | 3 |
| Ex. 5 | 5 | 4 | 5 | 5 |
| Comp. Ex. 1 | 1 | 2 | 1 | 4 |
| Comp. Ex. 2 | 3 | 1 | 5 | 2 |
| Comp. Ex. 3 | 2 | 2 | 2 | 3 |

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications No. 2006-311162, 2007-236088 and 2007-243514, filed on Nov. 17, 2006, Sep. 12, 2007 and Sep. 20, 2007, respectively, the entire contents of which are herein incorporated by reference.

What is claimed is:

1. A toner, comprising:

toner particles A having a circularity of greater than 0.93 and not greater than 1.00; and toner particles B having a circularity of from 0.85 to 0.93, wherein the following relationships are satisfied:

$$70 \le R_A \le 95$$

$$5 \le R_B \le 30$$

$$0.014 \le SD \le 0.025$$

$$0.940 \le ED \le 0.950$$

wherein $R_A$ (% by number) represents a ratio of a number of the toner particles A to a total number of toner particles included in the toner, $R_B$ (% by number) represents a ratio of a number of the toner particles B to the total number of toner particles included in the toner, SD represents a standard deviation of circularity of the toner particles A, and ED represents an average envelope degree of the toner particles B, wherein the toner particles A and the toner particles B are obtained by conducting a surface treatment by mixing colored particles with first silica particles and then flowing into a thermal current, and wherein the amount of the first silica particles is 0.20 part by mass to 0.40 part by mass relative to 100 parts by mass of the colored particles.

2. The toner according to claim 1, further comprising second silica particles having a number average primary particle diameter (R) of from 80 to 200 nm.

3. The toner according to claim 2, wherein the second silica particles have a shape factor SF-1 of from 100 to 130 and a shape factor SF-2 of from 100 to 125, and the following relationship is satisfied:

$$R/4 \le \sigma \le R$$

wherein R represents a number average primary particle diameter of the second silica particles and σ represents a standard deviation of particle diameter distribution of the second silica particles.

4. The toner according to claim 1, wherein both the toner particles A and B comprise a polyol resin and the toner has a ½ method melting temperature of from 100 to 115° C.

5. The toner according to claim 2, wherein both the toner particles A and B comprise a polyol resin and the toner has a ½ method melting temperature of from 100 to 115° C.

6. The toner according to claim 3, wherein both the toner particles A and B comprise a polyol resin and the toner has a ½ method melting temperature of from 100 to 115° C.

7. An image forming method, comprising:

forming an electrostatic latent image on an electrostatic latent image bearing member;

developing the electrostatic latent image with the toner according to claim 1 to form a toner image;

transferring the toner image onto a recording medium; and fixing the toner image on the recording medium by a non-contact fixing means.

8. An image forming method according to claim 7, wherein the toner further comprises second silica particles having a number average primary particle diameter (R) of from 80 to 200 nm.

9. An image forming method according to claim 8, wherein the silica particles have a shape factor SF-1 of from 100 to 130 and a shape factor SF-2 of from 100 to 125, and the following relationship is satisfied:

$$R/4 \le \sigma \le R$$

wherein R represents a number average primary particle diameter of the silica particles and σ represents a standard deviation of particle diameter distribution of the silica particles.

10. An image forming method according to claim 7, wherein both the toner particles A and B comprise a polyol resin and the toner has a ½ method melting temperature of from 100 to 115° C.

11. An image forming method according to claim 8, wherein both the toner particles A and B comprise a polyol resin and the toner has a ½ method melting temperature of from 100 to 115° C.

12. An image forming method according to claim 9, wherein both the toner particles A and B comprise a polyol resin and the toner has a ½ method melting temperature of from 100 to 115° C.

13. A process cartridge detachably attachable to an image forming apparatus, comprising:

an electrostatic latent image bearing member configured to bear an electrostatic latent image; and a development device which includes the toner according to claim 1 and configured to develop the electrostatic latent image with the toner.

14. A process cartridge according to claim 13, wherein the toner further comprises second silica particles having a number average primary particle diameter (R) of from 80 to 200 nm.

15. A process cartridge according to claim 14, wherein the second silica particles have a shape factor SF-1 of from 100 to 130 and a shape factor SF-2 of from 100 to 125, and the following relationship is satisfied:

$$R/4 \leq \sigma \leq R$$

wherein R represents a number average primary particle diameter of the second silica particles and σ represents a standard deviation of particle diameter distribution of the second silica particles.

16. A process cartridge according to claim 13, wherein both the toner particles A and B comprise a polyol resin and the toner has a ½ method melting temperature of from 100 to 115° C.

17. A process cartridge according to claim 14, wherein both the toner particles A and B comprise a polyol resin and the toner has a ½ method melting temperature of from 100 to 115° C.

18. A process cartridge according to claim 15, wherein both the toner particles A and B comprise a polyol resin and the toner has a ½ method melting temperature of from 100 to 115° C.

* * * * *